US006643987B2

(12) United States Patent
Rusch et al.

(10) Patent No.: US 6,643,987 B2
(45) Date of Patent: Nov. 11, 2003

(54) SUPPORTING ELEMENT FOR COVER STRIPS

(75) Inventors: Andreas Rusch, Lörrach (DE); Norbert Rusch, Schopfheim (DE)

(73) Assignee: Ernst Rüsch GmbH, Weil am Rhein (DE)

( * ) Notice: Subject to any disclaimer, the term of this patent is extended or adjusted under 35 U.S.C. 154(b) by 64 days.

(21) Appl. No.: 10/079,108

(22) Filed: Feb. 20, 2002

(65) Prior Publication Data

US 2002/0112431 A1 Aug. 22, 2002

(30) Foreign Application Priority Data

Feb. 20, 2001 (DE) ..... 101 07 864

(51) Int. Cl.[7] ..... E04B 2/00

(52) U.S. Cl. ..... 52/506.05; 52/287.1; 52/288.1; 52/272; 52/461; 52/463; 52/204.53; 52/204.54; 52/712; 52/718.04; 24/293; 24/294; 24/295; 24/287; 24/297

(58) Field of Search ..... 52/506.05, 287.1, 52/288.1, 272, 461, 463, 204.53, 204.54, 718.04; 24/289, 293, 294, 295, 297

(56) References Cited

U.S. PATENT DOCUMENTS

| | | | | | |
|---|---|---|---|---|---|
| 3,201,909 | A | * | 8/1965 | Grun | 52/288.1 |
| 3,302,350 | A | * | 2/1967 | Brown | 52/288.1 |
| 3,449,873 | A | * | 6/1969 | Damato et al. | 52/127.12 |
| 3,464,177 | A | * | 9/1969 | Amato | 52/288.1 |
| 3,638,374 | A | * | 2/1972 | Harby | 52/100 |
| 3,721,762 | A | * | 3/1973 | Gooding | 174/48 |
| 3,786,171 | A | * | 1/1974 | Shira | 174/98 |
| 4,534,147 | A | * | 8/1985 | Cristell | 52/288.1 |
| 4,723,580 | A | * | 2/1988 | Trautwein | 138/163 |
| 4,990,722 | A | * | 2/1991 | Benito Navazo | 174/97 |
| 5,024,614 | A | * | 6/1991 | Dola et al. | 439/114 |
| 5,025,604 | A | * | 6/1991 | Yeamans | 52/273 |
| 5,152,117 | A | * | 10/1992 | Wynar | 52/712 |
| 5,202,172 | A | * | 4/1993 | Graf | 428/100 |

(List continued on next page.)

FOREIGN PATENT DOCUMENTS

| | | | | | |
|---|---|---|---|---|---|
| DE | 1165235 | A | | 3/1964 | |
| DE | 3639127 | A1 | * | 5/1988 | E04F/19/04 |
| DE | 29719494 | U1 | | 2/1998 | |
| DE | 19723558 | A1 | | 12/1998 | |
| EP | 0560748 | B1 | | 9/1993 | |
| EP | 0652342 | A2 | * | 5/1995 | E04F/19/04 |
| EP | 0900897 | A2 | | 3/1999 | |

*Primary Examiner*—Carl D. Friedman
*Assistant Examiner*—Christy Green
(74) *Attorney, Agent, or Firm*—Volpe and Koenig, P.C.

(57) ABSTRACT

Supporting element of spring steel or plastic for separable fastening of cover strips (2) in the transition region between wall and floor panel (4). The supporting element is constructed as a one-piece clip which is clipped onto the floor panel from the front face, whereby the supporting element has a wall plate (5) and a clamping plate (6) projecting generally at right angles from the wall plate which, in the installed state of the supporting element, lies on the underside of the floor panel (4). Whereby the wall plate (1) has at least one first support section (7, 8) which in the installed state of the supporting element is braced on the upper side of the floor panels such that the upper and central part of the wall plate is acted upon in the direction of the wall. Whereby the wall plate has at least one second sprung support section (9, 10), which in the installed state of the supporting element is braced on the front face of the floor panel (4) such that the lower part of the wall plate is acted upon in the direction of the wall. The wall plate has at least a sprung holding tongue (11, 12) projecting from it the free end of which is separably fastenable on the cover strip (2).

10 Claims, 2 Drawing Sheets

U.S. PATENT DOCUMENTS 5,243,800 A * 9/1993 Olbrich ..... 52/287.1
5,274,972 A * 1/1994 Hansen ..... 52/220.5
5,359,817 A * 11/1994 Fulton ..... 52/288.1
5,383,318 A * 1/1995 Kelley et al. ..... 52/287.1
5,433,048 A * 7/1995 Strasser ..... 52/288.1
5,444,953 A * 8/1995 Koenig et al. ..... 52/282.1
5,537,791 A * 7/1996 Champagne ..... 52/520
5,598,681 A * 2/1997 DiGianni ..... 52/717.05
5,704,175 A * 1/1998 Lewis ..... 52/288.1
5,720,460 A * 2/1998 Watson ..... 248/297.21
5,732,747 A * 3/1998 Holliday ..... 138/163
5,822,941 A * 10/1998 Kinsella ..... 52/506.05
5,836,113 A * 11/1998 Bachman ..... 52/94
5,884,690 A * 3/1999 Zussman et al. ..... 165/55
6,084,180 A * 7/2000 DeBartolo, Jr. et al. ..... 174/95
6,115,982 A 9/2000 Lindenberg
6,122,872 A * 9/2000 Sauter ..... 52/288.1
6,186,605 B1 * 2/2001 Nelson ..... 312/140.4
6,323,421 B1 * 11/2001 Pawson et al. ..... 174/48
6,381,915 B1 * 5/2002 Wood ..... 52/718.06
6,469,250 B1 * 10/2002 Decore et al. ..... 174/95
6,499,198 B2 * 12/2002 Eckenrode ..... 24/295
6,501,026 B1 * 12/2002 Piole et al. ..... 174/99 R
6,513,289 B1 * 2/2003 Decore et al. ..... 52/288.1
D473,662 S * 4/2003 Shaw ..... D25/119
6,550,192 B1 * 4/2003 Nelson et al. ..... 52/177
6,557,311 B1 * 5/2003 Mongelli ..... 52/288.1
6,560,944 B1 * 5/2003 Wilson ..... 52/717.01

* cited by examiner

SUPPORTING ELEMENT FOR COVER STRIPS

BACKGROUND

The invention concerns a supporting element of spring steel or plastic for separable attachment of cover strips on a wall, for covering the transition between a wall and a floor panel or the like, whereby the supporting element has means for fastening it to the floor panel or the like, and means for separable supporting of the cover strips are provided.

Cover strips are used as base boards in the floor area in order to cover the transition between the floor and the wall or also as cover strips for the transition between a wall and a cover panel or a work surface.

Cover strips of this type were previously nailed or screwed directly on the wall and fastened with the interposition of clips which are pinned into the wall. For this, clips are used which have spring tongues which engage or latch into recesses of the cover strip so that the cover strip, if need be, can be rapidly removed and installed again.

The disadvantage is that holes must be bored into the wall. This is expensive and does not always enable a precise installation of the cover strip.

From European Patent Application EP 0 900 897 A2, an installation system for base board in accordance with the preamble of claim 1, in connection with which no boring in the wall is necessary, is known. This system consists of two parts, namely a U-shaped clip which is clipped on like a table cloth holder from the front face of the floor panel and an L-shaped spring contour, which is inserted into the plug-in groove of the clip and has a supporting section pointing upward on which, after mounting both parts on the floor panel, the base board (which has a slot on its lower narrow side) is put on. In accordance with a variant, the base board has a plug-in spring formed thereon which is inserted into the plug-in groove of the clip and thus holds the base board.

The disadvantage with this system is that the supporting element consists of two parts or can only be used in connection with a strip which has a plug-in spring formed thereon and possesses no device which guarantees a secure hold of the clip and a pressing of the base board upper edge on the wall. In the event of enlargement of the expansion joint between wall and base surface, there exists namely the danger that the U-shaped clip will no longer lie completely on the wall, but will rather form a gap toward the wall and this gap will also arise between base board and wall.

SUMMARY

Therefore, it is the object of the invention to provide a supporting element for a cover strip which is simple to manufacture, which requires no fastening holes in the wall, which brings about an exact fitting hold of the strips, and which enables a separable fastening of the strips.

The object is accomplished in accordance with the invention in that the supporting element is constructed as a one-piece clip which for installation from the front face of the floor panel or the like is clipped thereon, in that the supporting element has a wall plate which in the installed state of the supporting element lies on the wall, and a clamping plate projecting from the wall plate at approximately right angles which in the installed state of the supporting element lies on the underside of the floor panel or the like, in that the wall plate has at least a first support section which, lying at a distance from the clamping plate, is provided on the upper and middle part of the wall plate, and proceeding from this is braced in the installed state of the supporting element on the upper side of the floor element or the like so that these parts of the wall plate are acted upon in the direction of the wall, and in that the wall plate has at least a second sprung support section which is provided on the lower part of the wall plate lying closer to the clamping plate, and proceeding from this, in the installed state of the supporting element, is braced on the front face of the floor panel or the like so that this lower part of the wall plate is acted upon in the direction of the wall, and in that the wall plate has at least one sprung holding tongue, the free end of which is separably attachable on the cover strip.

The supporting element of the invention is simple to assemble and guarantees a secure separable fastening of different cover strips. For installation, the supporting element to be clipped from the front face on a floor panel, a ceiling panel or a work surface. The first support section which lies with its lower free end on the upper side of the floor panel, guarantees in connection with the clamping section lying on the underside of the panel a secure fastening of the supporting element on the panel. In this assembled state, the wall plate of the supporting element lies on the wall. The first support section ensures that the wall place is pressed on the wall in its areas lying at a distance from the clamping plate, while the second supporting element, which is spring braced against the front face of the panel, ensures that the wall plate is also pressed with its region lying nearer the clamping plate against the wall.

This second sprung support section is, with reference to its shape and spring characteristics, constructed such that it is fitted to the expansion joint existing between the wall and front face of the first floor panel and bridges these such that the wall plate is pressed with its lower part on the wall, independently of the movements in the expansion joint, and consequently lies completely on this. This primarily guarantees that the assembled base board likewise completely lies upon the wall. The first support section is shaped and constructed such that it exerts a bracing force which, proceeding from its lower free end lying on the upper side of the floor panel, runs obliquely upward to the upper or central region of the wall plate. In this way, it is first of all guaranteed that even the upper and middle region of the wall plate constantly completely lies on the wall. Second, through the lower free end of the first supporting section lying on the floor panel in connection with the clamping plate lying on the lower side of the floor panel, the supporting element is fastened on the floor plate. The pressure which the first supporting section exerts on the upper side of the floor panel is proportioned such that indeed a pressing of the wall plate on the wall is continuously taking place, but on the other hand, under the spring force exerted by the second supporting section, an automatic displacement of the supporting element on the floor panel can take place if motions appear in the expansion joint, and these are compensated by the second sprung supporting section.

For installation, the supporting element is placed on the panel lying closest to the wall. Then this panel is laid in the usual manner, and subsequently the cover strip is latched onto the holding tongues or tongues of the supporting element. The shape and number of holding tongues is here selected such that can interact with the type of cover strip selected. In practice, supporting elements can consequently be manufactured with different types of holding tongues so that an easy adaptation to the cover strip used in any given case is possible.

Especially advantageous is a supporting element in which the wall plate has a spring holding tongue arranged in the upper part and a sprung holding tongue arranged in the lower part. The holding tongues in the upper part of the wall plate have a section projecting from the wall plate at right angles or at an angle thereto, and have a contact end bent from the section, whereby the contact end is bent upward and especially toward the inside toward the wall plate, whereby the contact end is bent obliquely downward and outside away from the wall plate. A supporting element constructed in this manner interacts especially advantageously with a cover strip which has recesses oriented toward the bending of the contact ends so that the upper holding tongue acts upon the cover strip in the direction of the wall and the lower holding tongue acts upon the cover strip in the direction of the floor.

It is of particular advantage if two first supporting sections are provided which are arranged in a mirrored, symmetrical manner on the two vertical edges of the wall plate, and are constructed as support lugs bent at approximately right angles from these vertical edges, and if two second sprung support sections are provided which are arranged in a mirrored, symmetrical manner in the lower part of the wall plate adjacent to the clamping plate on its two vertical edges and are constructed as support tongues bent from these vertical edges at an acute angle toward the plane of the wall plate forward.

With this configuration, the supporting element can be manufactured in one piece from a spring steel plate.

Further advantageous configurations are indicated in the remaining dependent claims.

The invention also concerns a kit including of floor elements, such as panels, laminate plates or the like, base boards and supporting elements.

The invention furthermore concerns the use of supporting elements according to the invention for fastening cover strips in the transition region between two surfaces running basically at right angles toward each other, as between wall and floor, ceiling, work surface or the like.

BRIEF DESCRIPTION OF THE DRAWINGS

A preferred embodiment of the invention will be described in greater detail below on the basis of the appended drawings, wherein.

DETAILED DESCRIPTION OF THE PREFERRED EMBODIMENTS

Figure 1:
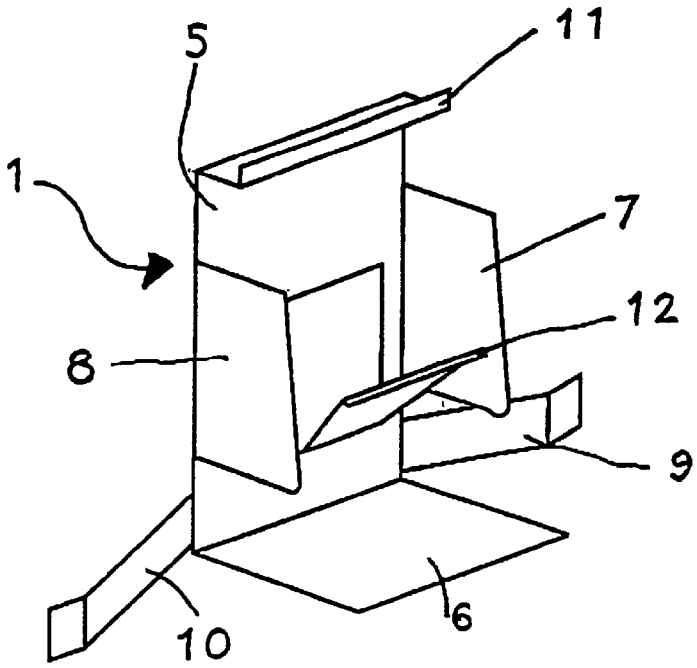
FIG. 1 is a perspective representation of the supporting element in accordance with a preferred embodiment of the invention.

The supporting element is constructed as a one-piece clip of spring steel or plastic. The supporting element has a vertical wall plate 5 which lies on the wall 3 in the installed state of the supporting element. A clamping section 6 projects from the wall plate generally at right angles which in the installed state reaches under a floor panel 4 and lies on the underside of the panel. A flap-like first support section 7, 8 is in each case arranged on the two vertical edges of the wall plate which in any given case is bent at approximately right angles forward from the wall plate. Each support section 7, 8 has a somewhat trapezoidal shape and lies with its lower free tip in the installed state of the supporting element on the upperside of the panel 4 such that the wall plate is pressed against the wall with its upper and middle region. As is especially apparent from FIGS. 2 and 3, each first support section 7, 8 lies with its lower free tip on the upper side of the floor panel and the lower edge of each support section runs obliquely upward toward the clamping plate and has (apart from the tip, which forms a point-shaped bearing) no contact with the upperside of the base panel. Through this profiling of the first support section, a resultant force arises which is directed proceeding from this lower free tip upward toward the wall plate and consequently presses the central and upper area of the wall plate toward the wall. In accordance with an alternate embodiment (not illustrated), each first support section could be constructed in tongue-like form and run, proceeding from the central or upper region of the wall plate obliquely downward toward the upper side of the floor panel and lie on the floor panel with its free end which is bent flat. It is important in connection with this that the first support sections first of all press the wall plate in its upper region against the wall and secondly together with the clamping plate 6 hold the supporting element on the base panel such that the supporting element can automatically move in relation to the floor panel if motions arise in the expansion joint between wall and front face of the floor panel. In its lower region near the connection to the clamping plate 6, the wall plate has in any given case on both vertical edges a second sprung support section 9, 10 which is bent slightly forward at an acute angle toward the plane of the wall plate, and whose free end is once again bent such that these two support sections in the installed state of the holding element are braced against the front face of the floor panel and in this way press the wall plate against the wall in its lower region as well. These second sprung support sections are, with respect to their form and spring characteristics, constructed such that they bridge the constantly present expansion joints between the front face of the first floor panel and the wall and are adapted to motions in the expansion joints and press the wall plate against the wall independently of the respective size of the expansion joints so that the wall plate continuously lies completely on the wall.

With changes in length of the floor panel as a consequence of temperature and moisture fluctuations, the supporting element can move in relation to the floor panel such that it always lies with its wall plate on the wall due to being subjected to action by the support section.

A spring holding tongue 11, 12 is now arranged in the upper and lower region of the wall plate in any given case which at all times projects forward away from the wall plate and whose free ends are bent. The upper holding tongue 11 is, proceeding from the wall plate, slightly bent upward and the free end of this holding tongue is likewise bent upward approximately parallel to the wall plate or it can also be directed inwardly toward the wall plate.

The lower, more strongly upwardly bent holding tongue 12, is formed in a similar manner, the engagement end of which is slightly or more strongly bent outwardly and downwardly toward the base panel.

Figure 2:
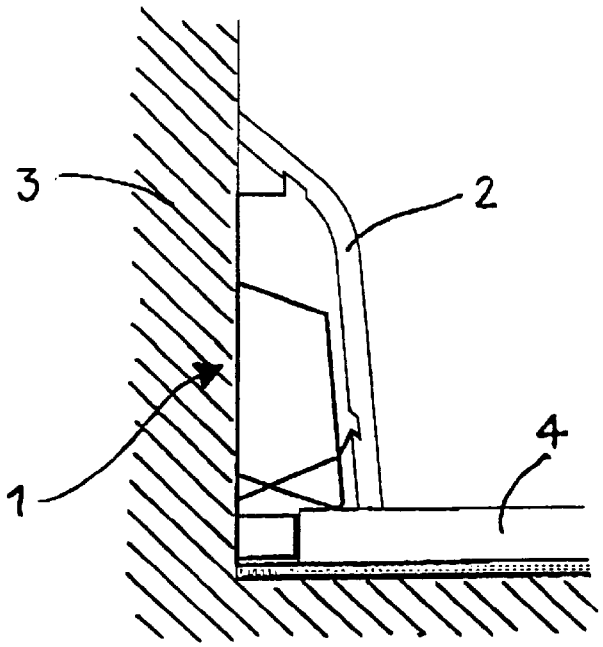
FIG. 2 is a sectional view through a supporting element as well as through rib; a cover strip connected with the supporting element.

In this way, as is apparent in FIG. 2, the two holding tongues can interact especially advantageously with a cover strip 2 which has on its reverse side, running longitudinally on the strip, recesses in the form of grooves, furrows or notches which with respect to their inclination are oriented such that, upon engagement of the holding tongues, the upper holding tongue 11 presses the strip in the direction of the wall 3 and the lower holding tongue 12 presses the strip in the direction of the base panel 5. After installation of the holding element on the base panel, only the cover strip needs to be brought to latching with the holding tongues. The interaction of holding tongues and recesses of the cover strip is such that the cover strip can be removed again and later reinstalled for purposes of inspection or the like without difficulty.

Figure 3:
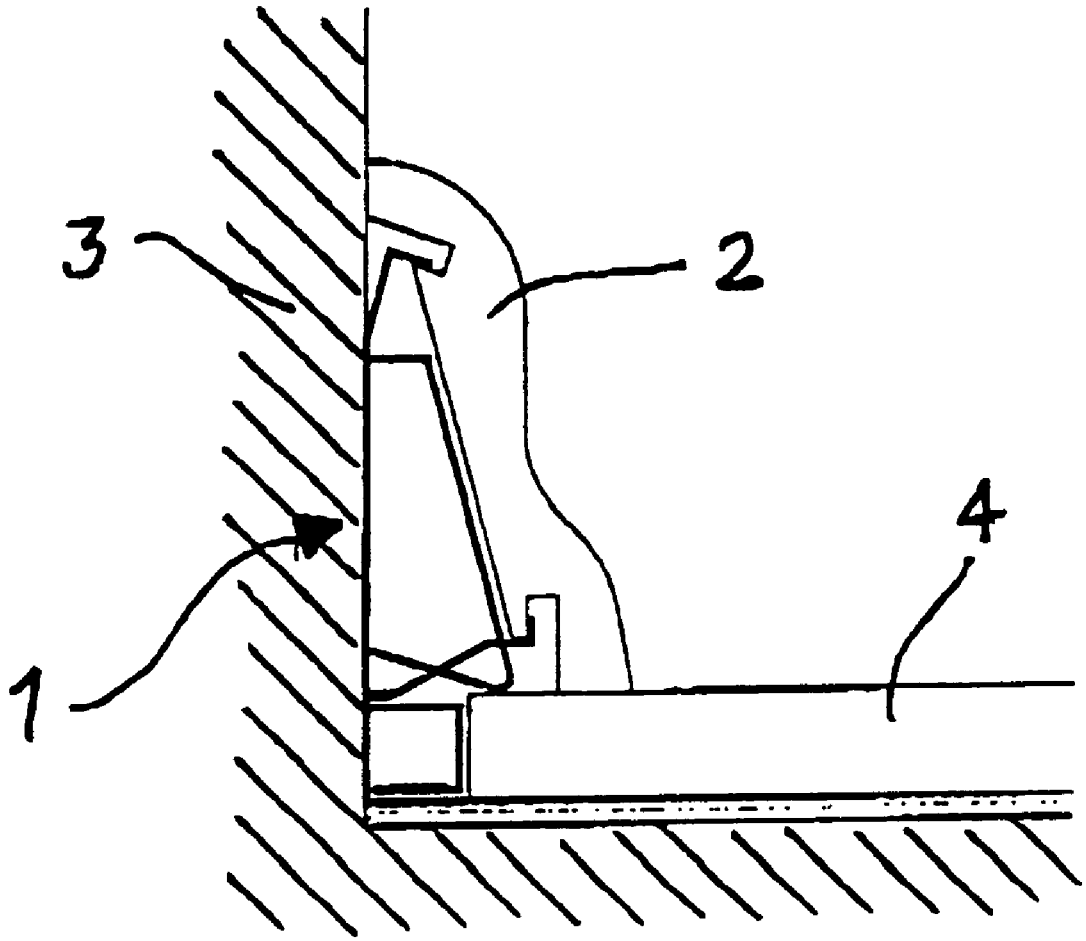
FIG. 3 is a sectional view through a supporting element adapted to another contoured cover strip with holding tongues adapted for this cover strip.

With the embodiment according to FIG. 3, the holding tongues have a different inclination proceeding from the wall plate that with the example according to FIG. 2, and the free ends of the holding tongues are also bent at another angle.

While in the embodiment according to FIG. 2, the upper holding tongue is only slightly inclined upwardly and the free end of the tongue is bent upward, and the lower holding tongue is inclined more strongly upward with a free end bent obliquely outwardly and upwardly, it is almost the reverse with the embodiment of FIG. 3. There the upper holding tongue is strongly upwardly inclined with a free end bent obliquely outwardly and downwardly, while the lower holding tongue has only a moderate upward inclination and its free end is bent upwardly. By outfitting with such holding tongues, the holding element of the invention can interact with the cover strip shown in FIG. 3, frequently used in practice.

For holding the cover strips, several holding elements are clipped onto the cover strip, whereby the number of holding elements and their mutual longitudinal distance are adapted to the cover strips used at any given time and their length.

The holding element described above is especially easy to manufacture from a spring steel plate in one piece. Here the plate is at first provided with corresponding cuts for the support section and the holding tongues and then the plate is bent in several steps to the form represented in FIGS. 1 and 3.

Of course, the supporting element can be outfitted with other holding tongues than with those depicted in FIGS. 1 to 3 which are adapted to the type of cover strip used in any given case with respect to length, inclination, bending, etc. Here it is important that the holding tongues can interact with recesses on the cover strip in order to guarantee a secure separable attachment of the strip. Thus, for example, deviating from FIG. 3, the lower sprung holding tongue could also placed into at about half the height of the wall plate or staggered further upward, and then have a section running proceeding from there running more or less obliquely downward. The end of this section is then bent into an engagement end interacting with a slot of the cover strip, for example upwardly or downwardly. The section of the holding tongues can also have a slightly cranked shape. The shape and length of the support section as well as the angle under which the support sections are bent from the wall plate can be adapted to the particular application.

The first support sections can also be configured such, for example through recesses in the support sections, that space is available for laying cables, tubes or the like which can be passed covered behind the cover strips. The clamping plates 6 can have a separated form, for example, separate clamping flaps can also be provided instead of a continuous plate.

Furthermore, the holding element can be used for fastening not only base boards for floors, but also for covering strips or for work surfaces. With covering strips, the supporting element is to be installed on the wall such that the clamping plate 6 does not lie on the visible side of the covering panel.

What is claimed is:

1. Supporting element of spring steel or plastic for separable fastening of a cover strip (2) on a wall (3) for covering a transition between a wall and a panel (4) extending generally perpendicular thereto, the supporting element comprises a lower part for fastening it to the panel (4) and a part for separable holding of the cover strip (2), wherein the holding element is constructed as a one-piece clip which, for installation, is clipped on to a front face of the panel, the holding element has a wall plate (5) which lies on the wall (3) in an installed state, and a clamping plate (6) projecting from the wall plate generally at right angles which in the installed state of the supporting element lies on an underside of the panel (4), the wall plate (5) has at least a first support section (7,8), spaced above the clamping plate and arranged in a central part of the wall plate, which in the installed state of the supporting element is braced on part of an upper side of the panel to press the central part of the wall plate towards the wall, the wall plate has at least a second sprung support section (9, 10) which is provided on a lower part of the wall plate lying nearer to the clamping plate that is braced in the installed state of the supporting element on the front face of the panel (4) such that the lower part of the wall plate is acted upon in the direction of the wall, and the wall plate has a sprung holding tongue (11, 12), a free end of the holding tongue is separably fastenable on the cover strip (2).

2. Supporting element according to claim 1, wherein the wall plate (5) has two sprung holding tongues, a first sprung holding tongue (11) arranged in an upper part thereof and a second sprung holding tongue (12) arranged in the lower part thereof.

3. Supporting element according to claim 1, wherein the holding tongue (11) is located in an upper part of the wall plate and has a section projecting from the wall plate at an angle thereto and an engagement end bent from the section, whereby the engagement end is bent upwardly and inwardly toward the wall plate and the holding tongue (12) has a section projecting from the lower part of the wall plate at an angle thereto and an engagement end bent from the section, whereby the engagement end is bent obliquely downwardly and outwardly away from the wall plate.

4. Supporting element according to claim 1, wherein the wall plate (5) has two sprung holding tongues whereby the one holding tongue (11) is arranged in an area of a free upper edge of the wall plate and has a section projecting obliquely upward from the wall plate, and an engagement end projecting forward and downwardly from the section, and whereby the other holding tongue is arranged at about half a height of the wall plate or further upwardly and has an upwardly bent engagement end.

5. Supporting element according to claim 1, wherein two first support sections (7, 8) are provided which are arranged in a mirror-symmetric manner on two vertical edges of the wall plate and are constructed as support flaps bent from the vertical edges at approximately right angles.

6. Supporting element according to claim 5, wherein the support flaps have a triangular or trapezoidal shape.

7. Supporting element according to claim 1, wherein two second sprung support sections (9, 10) are provided which are arranged in a mirror-symmetric manner in the lower part of the wall plate adjacent to the clamping plate on two vertical edges of the wall plate and are constructed as support tongues bent forward from the vertical edges at an acute angle from the plane of the wall plate.

8. Supporting element according to claim 1, wherein the second sprung support section (9, 10) is adapted to be located in an expansion joint between wall and a front face of the panel to guarantee maintaining the expansion joint as well as a pressing of the wall plate (5) in the lower region thereof on the wall.

9. A kit comprising of floor elements, base boards and supporting elements, the supporting elements being formed of spring steel or plastic for separable fastening of a cover strip (2) on a wall (3) for covering a transition between a wall and a panel (4) extending generally perpendicular thereto, whereby the supporting element has a lower part for fastening it to the panel (4) and a part for separable holding of the cover strip (2), wherein the holding element is constructed as a one-piece clip which, for installation, is clipped on to a front face of the panel, the holding element has a wall plate (5) which lies on the wall (3) in an installed state, and a clamping plate (6) projecting from the wall plate generally at right angles which in the installed state of the supporting element lies on an underside of the panel (4), the wall plate (5) has at least a first support section (7,8), spaced above the clamping plate and arranged in a central part of the wall plate, which in the installed state of the supporting element is braced on part of an upper side of the panel to press the central part of the wall plate towards the wall, the wall plate has at least a second sprung support section (9, 10) which is provided on a lower part of the wall plate lying nearer to the clamping plate that is braced in the installed state of the supporting element on the front face of the panel (4) such that the lower part of the wall plate is acted upon in the direction of the wall, and the wall plate has a sprung holding tongue (11, 12), a free end of the holding tongue is separably fastenable on the cover strip (2).

10. A method of installing of supporting elements to fastened cover strips in a transition region between two surfaces extending generally at right angles to each other, comprising:

installing a supporting element at the transition region, the supporting element being formed of spring steel or plastic for separable fastening of a cover strip (2) on a wall (3) for covering a transition between a wall and a panel (4) extending generally perpendicular thereto, whereby the supporting element has a lower part for fastening it to the panel (4) and a part for separable holding of the cover strip (2), wherein the holding element is constructed as a one-piece clip which, for installation, is clipped on to a front face of the panel, the holding element has a wall plate (5) which lies on the wall (3) in an installed state, and a clamping plate (6) projecting from the wall plate generally at right angles which in the installed state of the supporting element lies on an underside of the panel (4), the wall plate (5) has at least a first support section (7,8), spaced above the clamping plate and arranged in a central part of the wall plate, which in the installed state of the supporting element is braced on part of an upper side of the panel to press the central part of the wall plate towards the wall, the wall plate has at least a second sprung support section (9, 10) which is provided on a lower part of the wall plate lying nearer to the clamping plate that is braced in the installed state of the supporting element on the front face of the panel (4) such that the lower part of the wall plate is acted upon in the direction of the wall, and the wall plate has a sprung holding tongue (11, 12), a free end of the holding tongue is separably fastenable on the cover strip (2).

* * * * *